United States Patent [19]

Plath

[11] Patent Number: 4,751,829

[45] Date of Patent: Jun. 21, 1988

[54] KNITTING MACHINE

[75] Inventor: Ernst-Dieter Plath, Tailfingen, Fed. Rep. of Germany

[73] Assignee: Sipra Patententwicklungs-und Beteiligungs-Gesellschaft mbH, Tailfingen, Fed. Rep. of Germany

[21] Appl. No.: 938,051

[22] Filed: Nov. 17, 1986

[30] Foreign Application Priority Data

Nov. 16, 1985 [DE] Fed. Rep. of Germany ..... 3540685

[51] Int. Cl.[4] ..... D04B 15/32; D04B 15/24

[52] U.S. Cl. ..... 66/13; 66/28; 66/104; 66/106; 66/223

[58] Field of Search ..... 66/13, 62, 104, 106, 66/120, 38, 223

[56] References Cited

U.S. PATENT DOCUMENTS 1,877,503 9/1932 Gagne ..... 66/13
3,828,582 8/1974 Widdowson et al. ..... 66/13
4,423,606 1/1984 Hofmann ..... 66/13
4,608,839 9/1986 Tibbals, Jr. ..... 66/13

FOREIGN PATENT DOCUMENTS 3108041 9/1982 Fed. Rep. of Germany .
3311361 10/1984 Fed. Rep. of Germany .

*Primary Examiner*—Wm. Carter Reynolds
*Attorney, Agent, or Firm*—Michael J. Striker

[57] ABSTRACT

A circular knitting machine includes needles and loop-sinking sinkers longitudinally movable relative to each other in opposite directions. Each needle is provided with a non-movable slide. The movements of the needles and the sinkers are controlled by cams. Each slide has a tip. The control cam for the needle head and the control cam for the sinker and the height of the needle slide tip are selected so that the tips of the needle slides lie in the region which extends between the point of crossing of said control cams and the maximal vertical level of the knockover edge of the sinker.

7 Claims, 6 Drawing Sheets

D
C
B
A
60
61
X
64
63
61
23
25
13.1
Y
17
12.2
13
60
X1
66
65
12
12.3
62
67
25
13.1
68
17
12.2
13
12
12.2
64
67
13
17
12
23
13
67
12
12.2
13.1
23
17
67
12

KNITTING MACHINE

BACKGROUND OF THE INVENTION

The present invention relates to a knitting machine for making knitwear.

Knitting machines of the type under discussion include needles and loop-sinking/knockover sinkers which are interchangeably positioned in a knitting tool carrier and are adjusted by control cams so that the movable and pivotally supported sinkers are moved with their knockover edges longitudinally during the pull-off or retraction movement of respective needles at least partially in the opposite direction whereby the control cam of motion of the knockover edge for each sinker and the control cam of movement for the needle head of the respective needle cross each other in the region of needle withdrawal or retraction movement.

Knitting machines of the foregoing type have been disclosed, for example in DE-OS Nos. 31 08 041 and 33 11 361. By the movement of the needles and sinkers in the opposite directions in the region of loop sinking the sinkers are maintained flat and thereby the knitting machine is operated faster without danger of breaking of needles and thread. At high knitting speeds the problem occurs when latch needles are utilized in the knitting machine. This increases the danger of latch breaking because the swinging motion at high speeds causes considerable striking forces during the opening and closing of the tongue of the needle, which forces can cause the displacement of the tongue support. Also, abrasive effect of the processed yarn and of dust on the tongue support is enhanced.

SUMMARY OF THE INVENTION

It is an object of this invention to provide an improved knitting machine.

It is another object of the invention to provide a knitting machine which could operate at the same high operation speeds as the conventional knitting machines having latch needles but would not require additional expense for controlling the knitting tools.

These and other objects of the invention are attained by a knitting machine for making knitwear, comprising a needle cylinder carrying a plurality of needles; a sinker carrier carrying a plurality of loop-sinking and knockover sinkers, said needles and said sinkers being interchangeably arranged one after another; and control cams for adjusting said needles and said sinkers so that said sinkers and longitudinally displaceable and pivotable with knockover edges thereof during a withdrawal movement of respective needles, said sinkers at least in part of said displacement being longitudinally movable in an opposite direction, said cams having a movement curve for controlling a knockover edge of a knockover sinker and a movement curve for controlling a needle head of a respective needle, said curves crossing each other in a region of withdrawal of the needle, the improvement comprising each needle being provided with a slide immovably held at a constant level in at least said cylinder and sinker carrier and provided with a tip, said cams for adjusitng said needles and said sinkers being formed so that tips of the slides of said needles always lie in a region between a point of crossing (X) of said two curves and the highest level (Y) of said curve for controlling said knockover edge.

The adjusting cams for the needles and sinkers may have needle-adjusting cam portions and sinker adjusting cam portions.

The knitting machine may further include adjusting organs for adjusting said needle-adjusting cam portions and said sinker-adjusting cam portions relative to each other so that a vertical position of said point of crossing (X), of said curve for controlling said knockover edge and said curve for controlling said needle head remains unchanged in the region of pulling of the respective needle.

Due to the knitting machine according to this invention customary cams for controlling needle slides can be omitted and only cams for controlling a longitudinal movement of the needle shafts carrying needle heads are required as is the case with latch needles. The linear radial movement between the needle head and needle slide is naturally slower than the pivoting motion of the needle tongue tip so that, with the knitting machine of the proposed invention there would be no obstacles for increasing operation speeds. Due to the arrangement of the tip of the needle slide in the so-called movement-controlling cam region it is ensured that in each operation position, that are "knitting", "tuck" and "float" positions, the needle slides fulfill their function precisely and reliably.

Said adjusting organs may be rotation-eccentric devices, said adjusting organs being separately assigned to said needle-adjusting cam portions and said sinker-adjusting cam portions.

Said adjusting organs for adjusting needle-adjusting cam portions and for adjusting sinker-adjusting cam portions may be coupled with each other.

Each slide may have a foot projecting outwardly from a back side of the respective needle, at least said needle cylinder and said sinker carrier having a plurality of recesses each receiving a respective foot of the respective slide.

The sinker carrier may have a plurality of guide webs each provided with said recess.

The adjusting cams may be arranged on a cam ring having a circular track, each slide having a foot projecting outwardly from a back side of the assigned needle and projecting into said track.

Each sinker may have a projection, said foot of each slide being formed between said needle head and said projection which forms a pivoting location.

Said adjusting cams for said needles and said sinkers may have needle-adjusting cam portions and sinker-adjusting cam portions which are adjustable and interchangeable.

Each needle slide may be formed so that, upon a relative displacement of said needle in respect to said slide, said tip can pass said needle head.

Each needle may be displaceable to a "tuck" position in which said tip projects beyond a front edge of said needle in a direction towards the open needle head.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE PREFERRED EMBODIMENTS

DETAILED DESCRIPTION OF THE PREFERRED EMBODIMENTS

Figure 1:
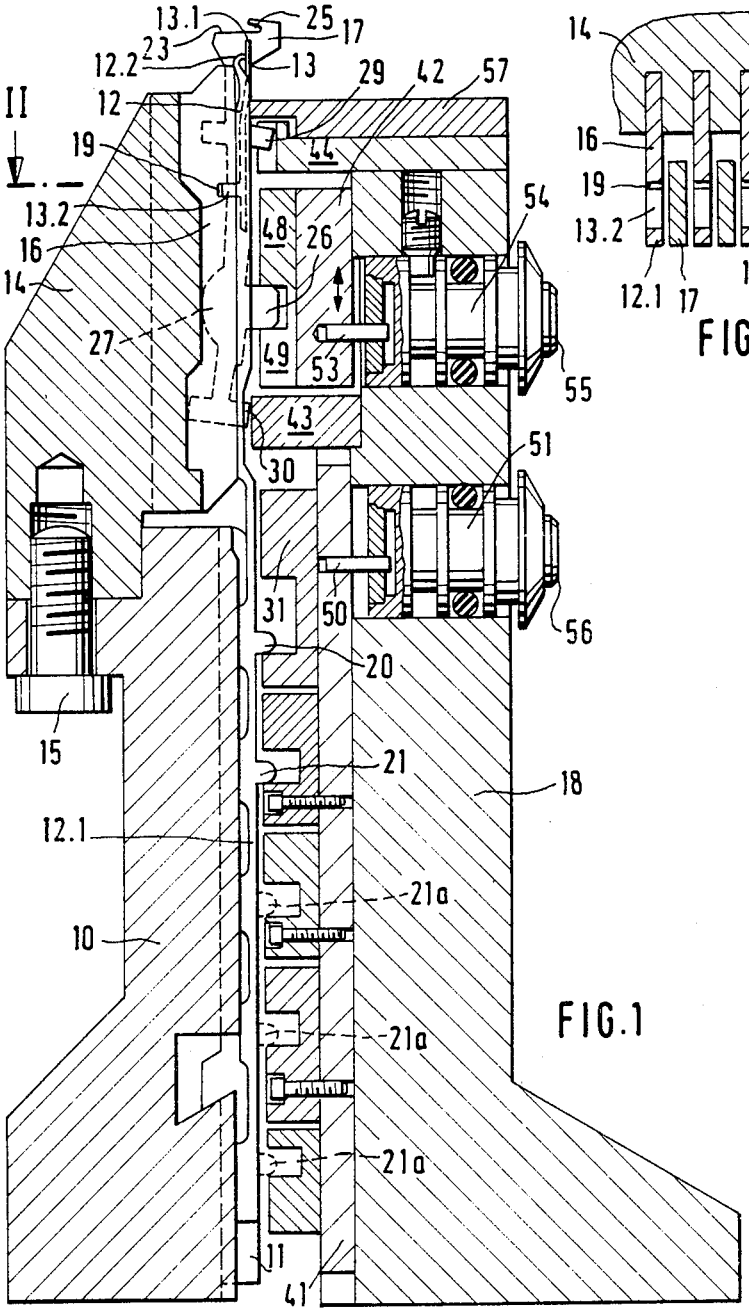
FIG. 1 is a sectional view of a needle-sinker carrier and a cylindrical cam ring of a circular knitting machine.

Referring now to the drawings in detail, FIG. 1 illustrates a circular knitting machine which includes a rotatable cylindrical knitting tool carrier which is subdivided into a needle cylinder 10 and a sinker cylinder 14. Both cylinders 10 and 14 are connected to each other by means of bolts 15. The peripheral face of the needle cylinder 10 is provided in the known fashion with axis-parallel guide webs 11 for guiding therebetween shafts 12.1 of displaceable needles 12 which are in the knitting machine of this invention so-called slide needles. In a sinker cylinder 14 coaxial with the needle cylinder, are positioned loop-sinking and knockover sinkers or sinking jacks 17 which are called short plates and are longitudinally displaceably and pivotally supported between axis-parallel guide webs 16. The guide webs 16 for sinkers 17 are inserted in the sinker cylinder 14 with a uniform spacing in the same manner as guide webs 11 of the needle cylinder 10. However guide webs 16 of cylinder 14 are spaced from the guide webs of the needle cylinder 10.

The needle cylinder 10 and the sinker cylinder 14 coaxial therewith are surrounded by a common cam ring 18 which has in the known manner cams for controlling the needles 12 and sinkers 17 as will be described in reference to FIG. 3. Below the heads 12.2 of the needles 12 is positioned a lower support 57 which acts on the needle shafts 12.1.

Figure 2:
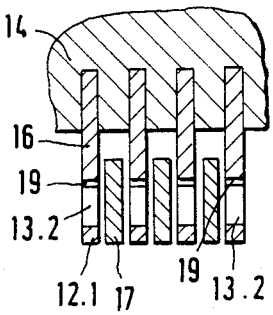
FIG. 2 is a partial sectional view of an edge region of the sinker carrier, taken along line II—II of FIG. 1, on enlarged scale.

The needle slides 13 which serve to close the needle heads or pin heads 12.2 are formed such that the tips 13.1 of these slides can pass the needle head 12.2 and they are immovably held in the rotating knitting tool carrier. Thus the needle slides 13 have feet or projections 13.2 which extend into recesses 19 formed in respective guide webs 16 whereas the needle back sides 12.3 of the needle shafts 12.1 slide on the end face of the respective guide webs 16 as seen in FIG. 2. The needle slides can also extend with their feet into a circular track of the cam box or ring 18; this solution can, however cause more extensive wear of the parts. The individual design of the slidable needle 12 and positioning of the slide 13 in the needle shaft 12.1 results in the fact that the needle slide tip 13.1 can pass the needle head 12.2 (not shown). As can be seen from FIG. 2 showing the needle arrangement on enlarged scale the arrangement of the needle shafts 12.1 relative to the sinkers and the locking positions (recesses 19) for the feet 13.2 of the needle slides 13 is provided.

The needles 12 are each provided in the region of the needle shaft 12 between the guide webs 11 of the needle cylinder 10, with a guide foot or leg 20 and a respective control foot 21. In the periphery of the cam box 18 are provided a plurality of guide tracks for the control feet 21 of the needles. The control feet of the adjacent needles are respectively offset by four steps relative to each other. The dotted lines in FIGS. 1 and 3 show control feet **21*a*** in three other possible steps.

Sinkers 17 are formed as loop-sinking-knockover plates with head portions specific for the sinkers of this type. The head portion of each sinker has (FIG. 1) a knockover edge 23 which merges at the end thereof into a loop-sinking throat 25 for sinking a loop. The longitudinal displacement of each sinker 17 is effected at a middle control foot 26 at the level of which each sinker is supported with a circular projection 27 on the sinker cylinder 14. The pivotal motion of the sinkers 17 at the projections 27 is controlled by presser feet 29 and 30 which are positioned on the relatively short sinker shaft at two sides of the control foot 26.

Figure 3:
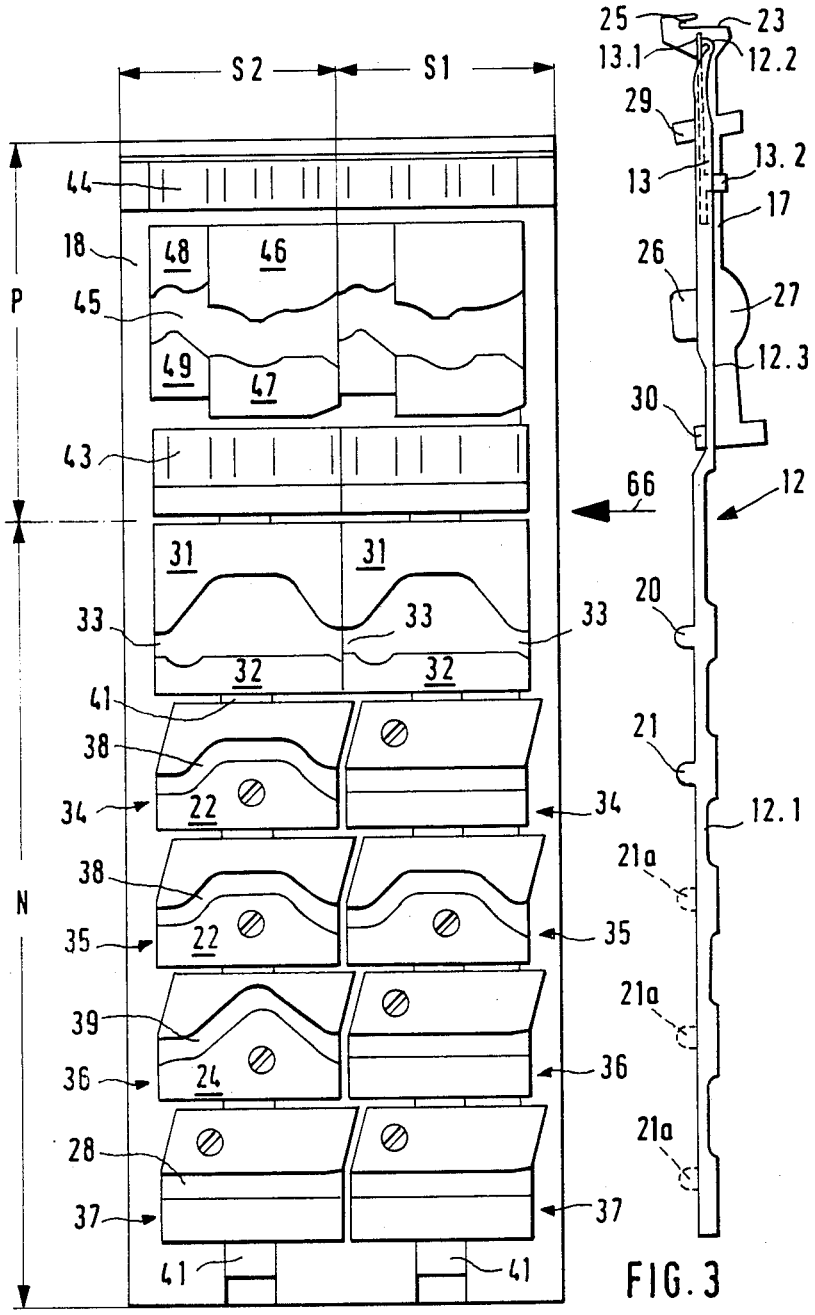
FIG. 3 is a view of the inner side of the cam ring of the circular knitting machine, over the width of two adjacent systems $S_1$, $S_2$ jointly with a side view of the knitting tool controlled by the cam ring.

FIG. 3 depicts, on two adjacent systems $S_1$ and $S_2$ of the cylindrical cam box 18, a region N for controlling the needles 12 and a region P for controlling sinkers 17. The needles and sinkers pass the cam box in the directions of arrow 66. The control cam regions N has in each system cam portions 31 and 32 which are provided to reliably guide needles 12 at their guide feet 20 at transition locations 33 between the systems. The control cam part 31 can function also as a knockover cam part. The remaining cam region N is subdivided into four control sections 34, 35, 36 and 37 which form four stages which correspond to control feet, 21, **21*a* of the needles 12. Different guiding tracks with exchangeable cams are formed in two control sections 34 to 37 so that guide tracks 38 are formed in control steps 34 and 35 of the system $S_2$. Control feet 21 or 21a of the needles 12 cooperate with respective guide tracks 38 to drive the needles up to a "tucking" position. In the control stage 36 of system $S_2$ a control track 39 is formed, with which a control foot 21*a* of the needle 20 cooperates so as to drive the needle to a full "knitting" position. In the lowermost cam portion 37 of the system $S_2$, is arranged an interchangeable cam with a so-called circular channel or passage 28 for the operation in a "float" position of the needles 12. The interchangeable cams with circular channels 28 are secured directly to a cam segment. Interchangeable cams 22, 24, 28 are insertable into each control cam stage or step 34-37**.

The cam regions P for sinkers 17 has a pressing cam 43 for influencing the presser foot 30 and a pressing cam 44 for influencing the presser foot 29 of each sinker 17. A cam channel 45 for the control foot 26 of the sinker 17 is formed between cams 46, 47 and 48, 49.

Both cams 48 and 49 of the cam region P for sinkers 17 are secured to an adjustable cam plate 42 shown in FIG. 1. This cam plate 42 is coupled via an eccentric pin 53 with an adjustment shaft 54 projecting outwardly from the cam box 18. Adjustment shaft 54 is terminated with an adjusting disc 55. In the cam region or portion N for controlling needles 12, the cams 31, 32 and knockover cams 22 and 24, which limit the guide tracks 38 and 39 in the control steps 34, 35 and 36, are secured on a common slide 41 which is coupled via an eccentric pin 50 with an adjustment shaft 51 which has at its end extended outwardly from the cam box 18 an adjusting disc 56. A loop-sinking path of sinkers 17 can be adjusted by the adjusting disc 55 whereas the loop forming path of the needles 12 can be adjusted by the adjusting disc 56. In the exemplified embodiment, these adjustments are separated from each other. The adjustment of the cam plate 42 and slide 41 can be also coupled to each other whereby differently formed eccentric shafts 51 and 54 would be driven by a non-shown common adjusting shaft.

Figure 4:
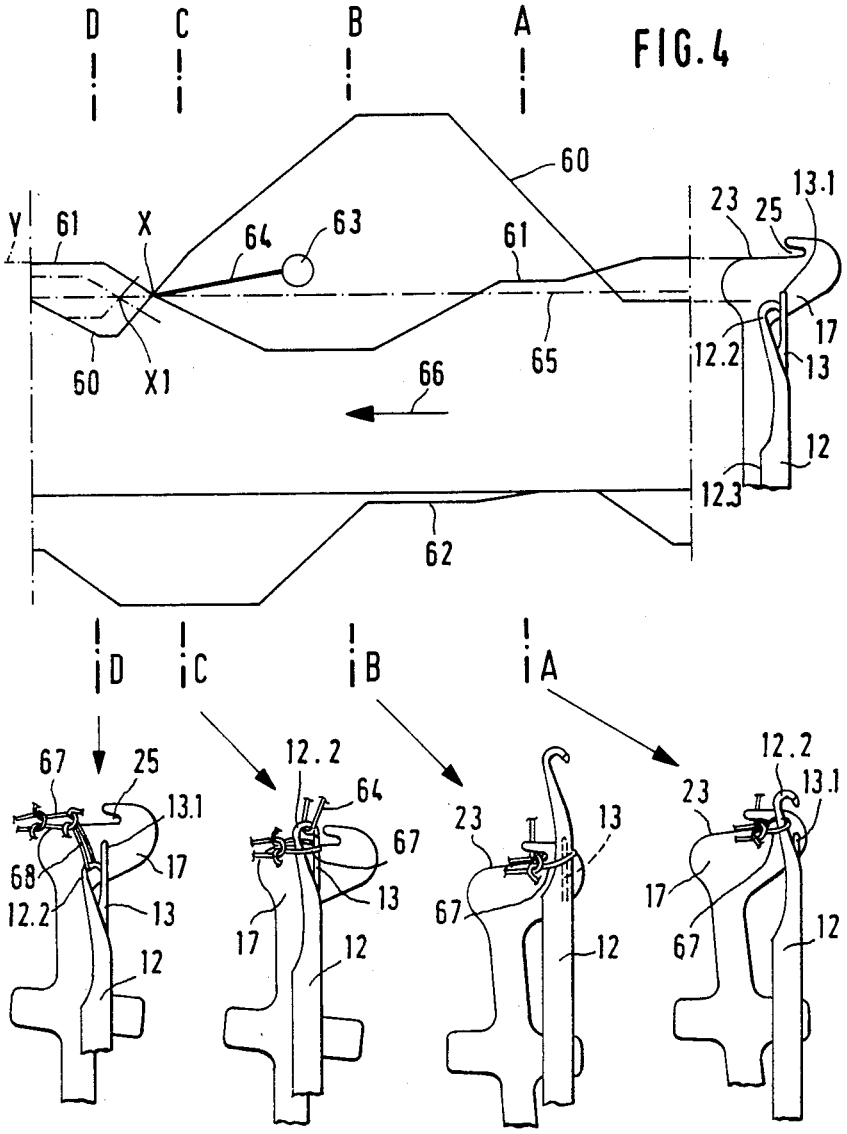
FIG. 4 is a schematic view of the control paths of the needle head and the knocking-over edge of the respective sinker and the relative position of the slide needle and the sinker at four predetermined locations A, B, C and D.
Figure 5:
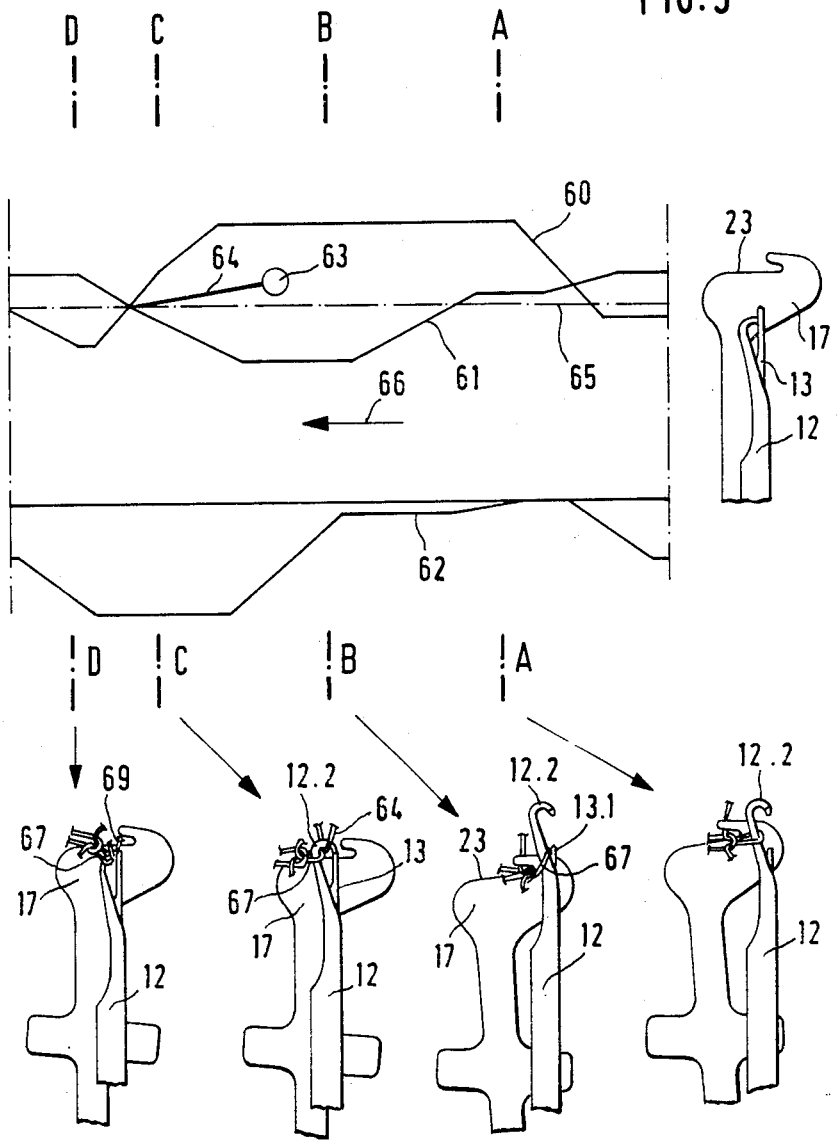
FIG. 5 is a schematic view similar to that of FIG. 5 but in the "tucking" position of the needle and respective sinker.
Figure 6:
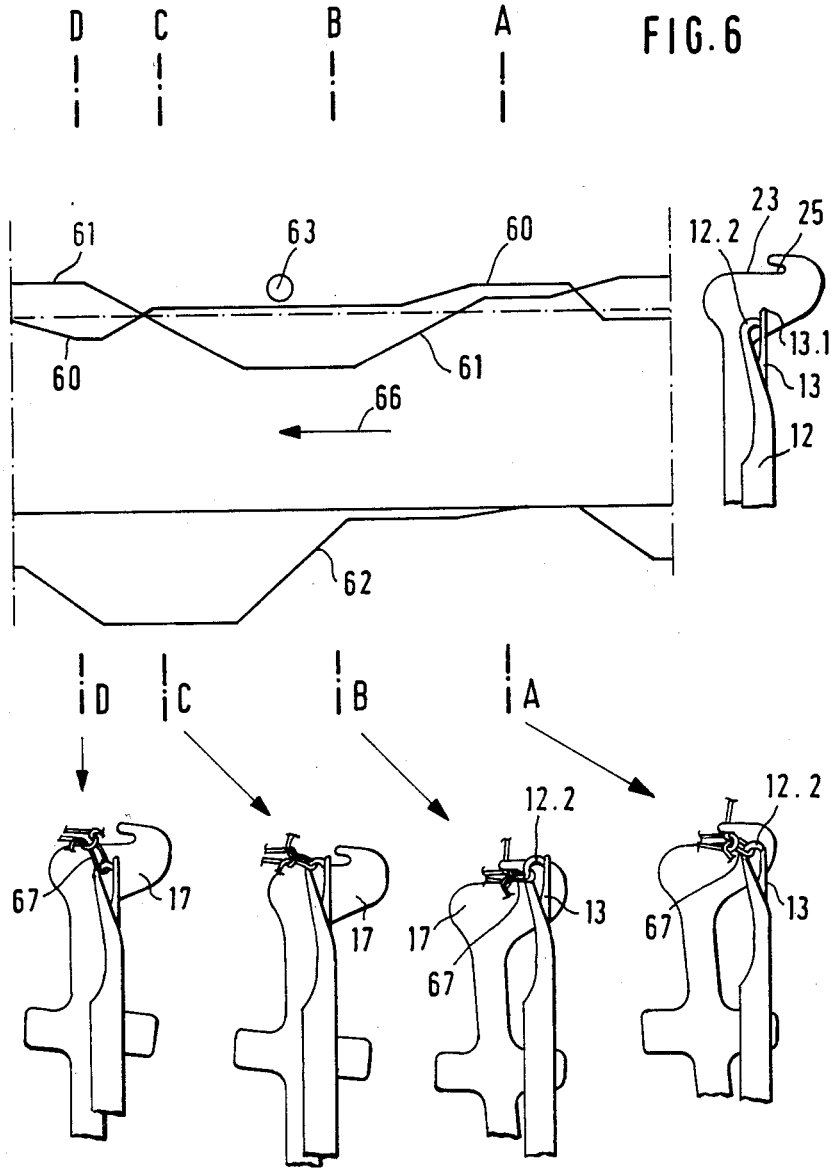
FIG. 6 is a schematic view similar to that of FIG. 4 but in the "float" position.

Movement curves 60, 61 and 62 in three different operation positions are illustrated in FIGS. 4 to 6. The movement path 60 is the curve which the head 12.2 of the needle 12 follows during its running through one system of the multi-system circular knitting machine. The movement path 61 is the path of the knockover edge 23 of the sinker 17 and the path 62 shows the important pivoting motion of sinker 17 for the loop-sinking process. The movement curves 61 and 62 of sinker 17 are the same in all three operational positions. The thread guide is schematically designated by a circle 63 and the thread conveyed by this guide is denoted by line 64 which is pulled to the point of crossing of the paths 60 and 61 in the needle knockover region of the system. The vertical position of the tip 13.1 of the immovable held needle slide 13 is shown in FIGS. 4 to 6 by a dash-dotted line 65. Furthermore the relative positions of the needle 12 to its slide 13 and to the respective sinker 17 are shown in all three FIGS. 4 to 6 at four different locations A, B, C and D of the control cams. The direction of movement of the needles 12 and sinkers 17 through the system of the cams is denoted by arrow 66.

FIG. 4 shows the course of the control cams in the "knitting" position. At the location A the needle 12 has been partially shifted and its head 12.2 is positioned above the tip 13.1 of the slide 13, the position of which is shown by dash-dotted line 65. The needle head 12.2 is also already partially opened. The sinker 17 is moved somewhat downwardly along its path 61 relative to its maximally remote radial position which is defined at two ends of the path 61. The old loop 67 is located yet in the needle head 12.2 and is prevented from being moved into the holding-down throat 25 of the sinker 17 by the needle 12. At the location B, the needle 12 is fully extended. The tip of the slide 13 is moved from the needles shaft and the old loop 67 appears on the needle chest and needle shaft and is taken by the slide 13. The sinker 17 is fully pulled away along the path 61.

At the location C the needle 12 is further pulled along its cam control cam 60 so far that the needle head 12.2 grips the thread 64 fed by the thread guide 63. The slide 13 has the needle head nearly closed. The old loop 67 is now positioned outside the needle head on the slide 13. The sinker 17 follows its cam 61 and is fully pivoted back so that the old loop 67 does no longer lie in the holding-down throat 25. When the needle head 12.2 reaches the tip of the slide 13 the knockover edge 23 of the respective sinker is positioned below the tip 13.1 and also below the line 65.

The immovably held tip 13.1 of the slide is positioned at the crossing point X at the level 65 whereas the needle head 12.2 and the knockover edge 23 of the sinker 17 lie at the same level and on the dash-dotted line 65.

At the location D, the needles 12 are fully pulled off along the curve or path 60 and sinkers 17 are fully driven along their control path 61. The old loop 67 is knocked over by the needle head 12.2 and a new pulled loop 68 hangs on the needle head 12.2 which has passed through the tip 13.1 of needle slide 13.

FIG. 5 illustrates the movement curve 60 for controlling the needle head and the unchanged movement 61 for the knockover edge of the sinker and also a pivoting path 62 for sinker 17 in the "tuck" operation position. At the location A, the needle 12 has been moved along its path 60 to its full "tuck" position. The relative position of the needle and the sinker 17 is the same as in the "knitting" position according to FIG. 4.

At the location B, the needle 12 is further moved to the "tuck" position. The sinker 17 is in the loop-sinking position. The needle head 12.2 is only half-opened so that the old loop 67 taken along by the fully withdrawn sinker is prevented by the tip 13.1 of the slide 13 from moving from the needle head 12.2. The loop also remains behind the slide 13 in the needle head 12.2.

At the location C, the needle 12 is again pulled so far that it has a new thread 64 taken along by the needle head. The needle head 12.2 is again nearly closed by the slide 13. The sinker 17 in its fully returned position follows path 61. The old loop 67 is positioned jointly with the new thread 64 in the needle head 12.2 so that at the location D with the fully expulsed needle 12 and fully withdrawn sinker 17, a tuck hook 69 hangs in the needle head next to the old loop 67.

FIG. 6 shows the movement curve 60 for the needle head 12.2 in the "float" position. The needles 12 are herein controlled so that the needle heads 12.2 are closed through the entire system by the needle slide 13 and the previously formed loop 67 remains in the needle head.

Adjusting discs 55 and 56 shown in FIG. 1 can change the expulsion cams 49 for sinkers 17, cams 31, 32 and withdrawal cams 22, 24 for needles 12 between the maximal sinking and the minimal sinking. FIG. 4 shows the course of control cams 60 and 61 when the maximal sinking of both knitting tools takes place. The dash-dotted line designates in FIG. 4 a modified course of the control cams when the minimal sinking of the knitting tools takes place. The adjustment is carried out so that, upon the adjustment to the minimal sinking, the displaced crossing point $X_1$ is positioned at the same level as that of the crossing point X, namely on the level 65 of the tip 13.1 of the immovable slide 13.

Figure 7:
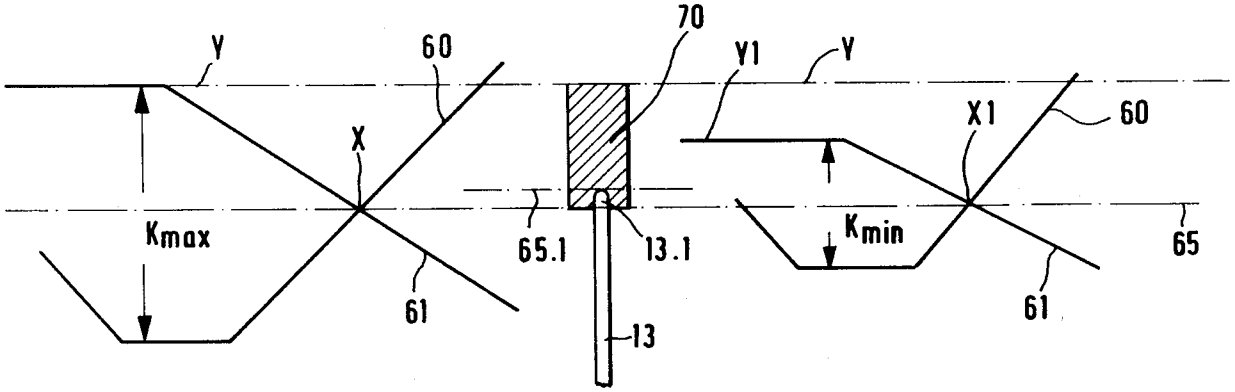
FIG. 7 is a partial view of the control cams in a pull-off region in the left-side halves during the maximal loop-sinking and in the right-side halves during the minimal loop-sinking.

The movement curve 60 for the needle head and curve 61 for the knockover edge 23 of sinker 17 in the loop-forming region are individually shown in FIG. 7. At the left side of FIG. 7 are the cams during the adjustment of the needles 12 and sinkers 17 for the maximal sinking Kmax, and at the right side of that figure are the cams during the adjustment for the minimal sinking Kmin. The highest level of the control path 61 for the knockover edge 23 of the sinker is designated with Y while the lowerest is denoted with Y1. A cross-hatched region 70 is the region in which the 13.1 of the tip immovably held slide 13 is passed by needles 12. The tip 13.1 is shown in FIG. 7 at the level 65.1 which lies somewhat above the level of the crossing point X or $X_1$ of control paths 60 and 61.

It will be understood that each of the elements described above, or two or more together, may also find a useful application in other types of knitting machines differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. What is claimed as new and desired to be protected by Letters Patent is set forth in the appended claims.

I claim:

1. In a knitting machine for making knitwear, comprising a needle cylinder carrying a plurality of needles; a sinker carrier carrying a plurality of loop-sinking and knockover sinkers, said needles and said sinkers being interchangeably arranged one after another; and control cams for adjusting said needles and said sinkers so that said sinkers are longitudinally displaceable and pivotable with knockover edges (23) thereof during a withdrawal movement of respective needles, said sinkers at least in part of said displacement being longitudinally movable in an opposite direction, said cams having a movement curve (61) for controlling a knockover edge of a knockover sinker and a movement curve (60) for controlling a needle head of a respective needle, said curves crossing each other in a region of withdrawal of the needle, the improvement comprising each needle being provided with a slide (13) immovably held at a constant level (65) in at least said cylinder and sinker carrier and provided with a tip (13.1), said cams (38, 49, 45) for adjusting said needles and said sinkers being formed so that tips of the slides of said needles always lie in a region between a point of crossing (X) of said two curves (60, 61) and the highest level (Y) of said curve (61) for controlling said knockover edge.

2. The knitting machine as defined in claim 1, wherein each slide has a foot (13.2), and said sinker carrier (14) has a plurality of guide webs (16) each provided with a recess, said foot projecting into said recess (19).

3. The knitting machine as defined in claim 2, wherein each sinker (17) has a projection (27), said foot of each slide being formed between said needle head and said projection which forms a pivoting location.

4. The knitting machine as defined in claim 3, wherein said adjusting cams (38, 39, 45) for said needles and said sinkers have needle-adjusting cam portions (22, 24) and sinker-adjusting cam portions (49) which are adjustable; and further including adjusting organs (50, 51, 53, 54) for adjusting said needle-adjusting cam portions and said sinker-adjusting cam portions relative to each other so that a vertical position of said point of crossing (X) of said curve (61) for controlling said knockover edge and said curve (60) for controlling said needle head remains unchanged in the region of pulling of the respective needle.

5. The knitting machine as defined in claim 4, wherein said adjusting organs are rotation-eccentric devices (51, 59), said adjusting organs being separately assigned to said needle-adjusting cam portions (22, 24) and said sinker-adjusting cam portions (49).

6. The knitting machine as defined in claim 4, wherein each slide is formed so that, upon a relative displacement of said needle in respect to said slide, said tip can pass said needle head.

7. The knitting machine as defined in claim 6, wherein each needle is displaceable to a tuck position in which said tip projects beyond a front edge of said needle in a direction towards the open needle head.

* * * * *